US009932758B2

(12) United States Patent
Genta

(10) Patent No.: US 9,932,758 B2
(45) Date of Patent: Apr. 3, 2018

(54) WATERTIGHT DOOR OR WINDOW

(71) Applicant: OPACMARE S.r.l., Turin (IT)

(72) Inventor: Roberto Genta, Turin (IT)

(73) Assignee: OPACMARE S.r.l., Turin (IT)

( * ) Notice: Subject to any disclaimer, the term of this patent is extended or adjusted under 35 U.S.C. 154(b) by 0 days.

(21) Appl. No.: 15/205,111

(22) Filed: Jul. 8, 2016

(65) Prior Publication Data

US 2017/0016253 A1 Jan. 19, 2017

(30) Foreign Application Priority Data

Jul. 16, 2015 (EP) ..... 15177145

(51) Int. Cl.

| | |
|---|---|
| ***E05F 15/00*** | (2015.01) |
| ***E05B 63/24*** | (2006.01) |
| ***B63B 19/00*** | (2006.01) |
| ***E05B 65/00*** | (2006.01) |
| ***E05C 9/04*** | (2006.01) |

(Continued)

(52) U.S. Cl.

CPC ..... *E05B 63/246* (2013.01); *B63B 19/00* (2013.01); *E05B 65/001* (2013.01); *E05C 5/00* (2013.01); *E05C 9/04* (2013.01); *E05C 9/1808* (2013.01); *E05C 9/1875* (2013.01); *B63B 2019/0053* (2013.01); *E05B 15/0295* (2013.01); *E05B 47/0001* (2013.01); *E05B 51/02* (2013.01)

(58) Field of Classification Search

CPC .. E05B 63/246; E05B 65/001; E05B 15/0295; E05B 51/02; E05B 47/0001; E05C 9/1875; E05C 9/1808; E05C 5/00; E05C 9/04; B63B 19/00; B63B 2019/0053

USPC ..... 49/279–302; 292/341.12, 341.13

See application file for complete search history.

(56) References Cited

U.S. PATENT DOCUMENTS

| | | | | |
|---|---|---|---|---|
| 1,573,866 A | | 2/1926 | Rogers | |
| 2,511,267 A | * | 6/1950 | Jacob | E05C 9/063 114/117 |

(Continued)

FOREIGN PATENT DOCUMENTS

| | | | | |
|---|---|---|---|---|
| EP | 0534833 A1 | * | 3/1993 | E05C 3/24 |
| GB | 2408066 A | | 5/2005 | |
| GB | 2502267 A | | 11/2013 | |

OTHER PUBLICATIONS

European Search Report for EP 15 17 7145 dated Jan. 25, 2016.

*Primary Examiner* — Jerry E Redman
(74) *Attorney, Agent, or Firm* — Arent Fox LLP

(57) ABSTRACT

A watertight door or window comprising a frame and a leaf mounted on the frame and arranged movably with respect thereto between an open position and closed position, and further comprising: a striker element arranged on the leaf, a locking element arranged on the frame and provided with a hook end designed to engage with the striker element so as to lock the leaf against the frame following closing of the leaf, and a striker actuating mechanism arranged on the leaf and able to be actuated when the leaf is in a closed position and the locking element is engaged with the striker element. The actuating mechanism is provided for releasing the striker element from a closed position, where the striker element is positioned inside a recess in the hook end of the locking element, to an open position, where the striker element is extracted from the recess in the hook end of the locking element. The actuating mechanism can be reset when the leaf is closed again.

8 Claims, 17 Drawing Sheets

(51) Int. Cl.

| | |
|---|---|
| ***E05C 5/00*** | (2006.01) |
| ***E05C 9/18*** | (2006.01) |
| *E05B 47/00* | (2006.01) |
| *E05B 51/02* | (2006.01) |
| *E05B 15/02* | (2006.01) |

(56) References Cited

U.S. PATENT DOCUMENTS 2,511,268 A * 6/1950 Schiff ..... E05C 9/16 114/117
2,865,313 A 12/1958 Morehouse
2,966,864 A 1/1961 Weaver
3,180,303 A * 4/1965 Hamilton ..... B63B 19/24 114/203
3,936,086 A 2/1976 Berkowitz
3,989,289 A * 11/1976 Ringe ..... E05B 83/10 292/218
4,159,136 A * 6/1979 Kimball ..... B62D 33/071 292/111
4,497,462 A * 2/1985 Hamatani ..... B64C 1/1415 244/129.5
5,022,691 A * 6/1991 Clay, Jr. ..... E05C 3/30 292/121
5,086,587 A * 2/1992 Andrews ..... E05B 65/001 292/240
5,199,369 A * 4/1993 Meyer ..... B63B 43/32 114/117
6,003,461 A * 12/1999 Blanchette ..... B63B 43/32 114/117
6,123,370 A * 9/2000 Rozema ..... E05B 17/0025 292/12
6,209,471 B1 * 4/2001 Oomen ..... B63B 43/32 114/117
6,260,304 B1 * 7/2001 Groeneveld ..... B63B 43/32 292/4
6,386,601 B1 * 5/2002 Heimann ..... E05B 17/08 292/256.5
6,390,514 B1 * 5/2002 Frolov ..... E05B 63/244 292/341.15
6,446,393 B1 * 9/2002 Marston, Sr. ..... B63B 19/24 292/196
6,474,705 B1 * 11/2002 Mori ..... E02F 9/163 292/216
6,799,396 B1 * 10/2004 Redfern ..... B63B 19/14 292/48
7,210,421 B1 * 5/2007 Pendergraph ..... B63B 43/24 114/78
2003/0111847 A1 * 6/2003 Hautmann ..... E05B 63/20 292/332
2005/0194795 A1 * 9/2005 Hapke ..... A47L 15/4259 292/216
2006/0075950 A1 * 4/2006 Dasilva ..... B63B 19/16 114/201 R
2006/0249958 A1 * 11/2006 Ruckert ..... E05B 83/24 292/110
2012/0061977 A1 * 3/2012 Takeda ..... E05B 81/20 292/201

* cited by examiner

WATERTIGHT DOOR OR WINDOW

FIELD OF THE INVENTION

The present invention relates to a watertight door or window, comprising a frame and a lead mounted on the frame and arranged movably with respect thereto.

BACKGROUND OF THE INVENTION

It is known that in the naval sector it is envisaged that the external doors in some categories of vessels must satisfy particular requirements as regards their water-tightness. For this purpose, the leaves of these doors are generally provided with seals. Locking systems are generally associated with the doors so that, when the leaves are closed against the frame of the door, a watertight seal is formed between leaf and frame of the door.

SUMMARY OF THE INVENTION

The invention relates to a watertight door or window comprising a frame and a leaf mounted on the frame and arranged movably with respect thereto between an open position and a closed position and further comprising:

a striker element arranged on the leaf, a locking element arranged on the frame and provided with a hook end designed to engage with the striker element in order to lock the leaf against the frame following closing of the leaf, and a striker actuating mechanism arranged on the leaf and able to be operated when the leaf is in a closed position and the locking element is engaged with the striker element, said actuating mechanism being provided for releasing the striker element from a closed position, where the striker element is positioned inside a recess in the hook end of the locking element, to an open position, where the striker element is extracted from the recess in the hook end of the locking element, and said actuating mechanism can be reset when the leaf is closed again.

Preferred embodiments of the invention are defined in the dependent claims which form an integral part of the present description.

According to a particular embodiment of the invention, the door or window further comprises a locking system which can be operated so as to lock the leaf against the frame when the leaf is in the closed position, wherein the locking system comprises a locking actuating mechanism intended to actuate the locking element, the locking element being arranged so as to be rotatable and displaceable in a guided manner, and wherein the striker actuating mechanism can be used as an emergency actuating mechanism for opening the leaf.

As a result of this embodiment it is possible to overcome malfunctioning problems which prevent operation of the locking system in order to unlock the door; the striker actuating mechanism used as emergency actuating mechanism which operates the striker element in fact prevents a malfunction of the locking system which actuates the locking element from blocking the possibility of exit.

BRIEF DESCRIPTION OF THE DRAWINGS

Further characteristic features and advantages of the door or window according to the invention will become clear from the following detailed description provided purely by way of a non-limiting example, with reference to the accompanying drawings in which.

DETAILED DESCRIPTION OF THE EMBODIMENTS OF THE INVENTION

With reference to the figures, these show a watertight fixture, in particular a watertight door designed to be installed on a boat. More generally, the invention may relate to different doors or windows which are designed to be installed on vehicles or fixed structures and which are required to have watertight characteristics.

Figure 1:
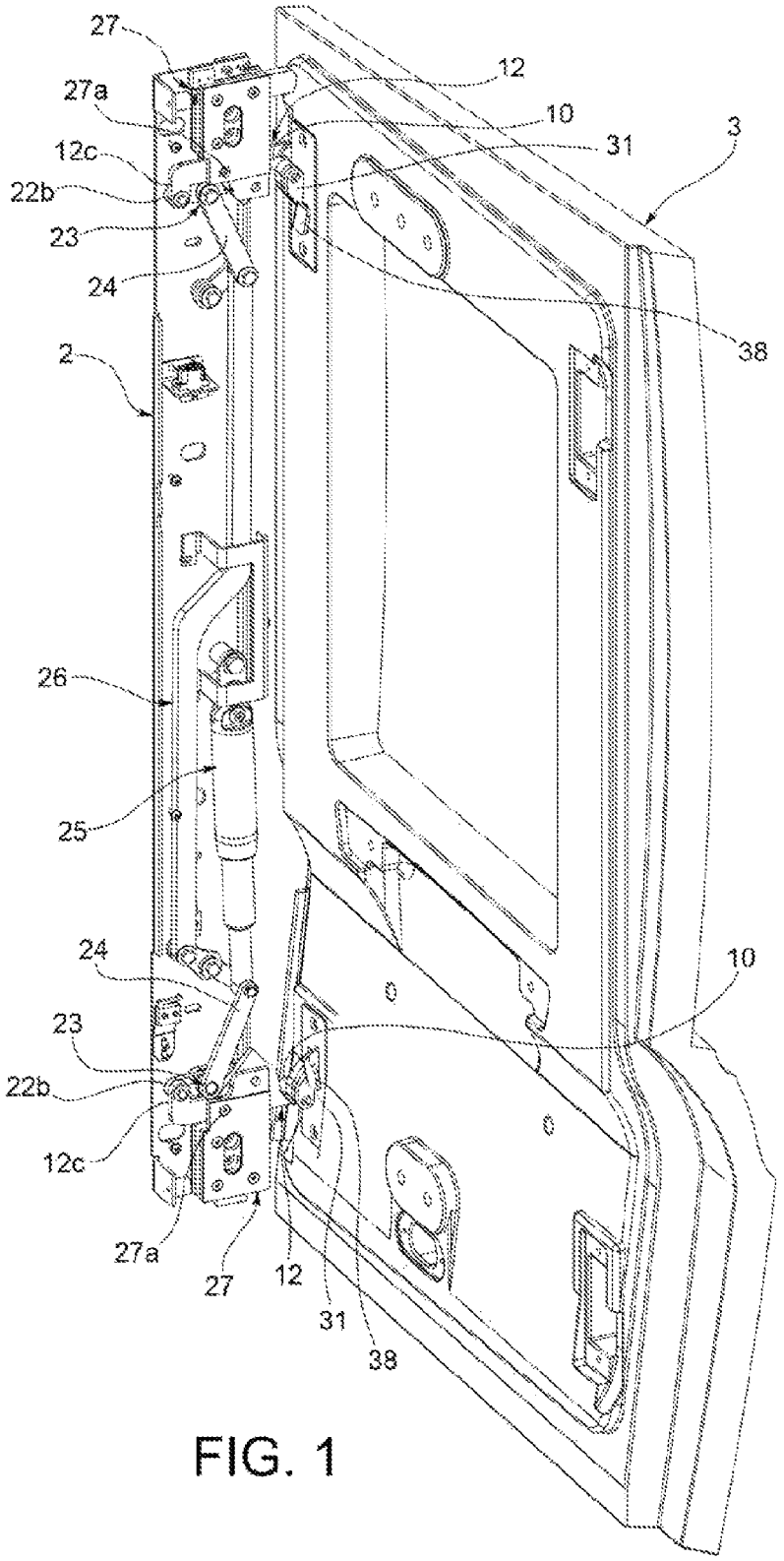
FIG. 1 is a perspective view which shows a watertight door according to the invention, in the closed position and with the locking system engaged.

The door shown comprises a frame 2, only a significant portion of which is shown for the sake of simplicity, and a leaf 3 mounted on the frame 2 and arranged movably with respect thereto between an open position and a closed position. In the example shown in the figures, the leaf 3 is hinged on the frame along a vertical side thereof, in particular the right-hand side in the illustration of FIG. 1. According to alternative embodiments (not shown), the leaf may be of the sliding type or provided with a combined rotational and translatory movement. The frame and/or the leaf are provided with seals (not shown) for forming a watertight seal between leaf and frame when the leaf is in the closed position.

Figure 2:
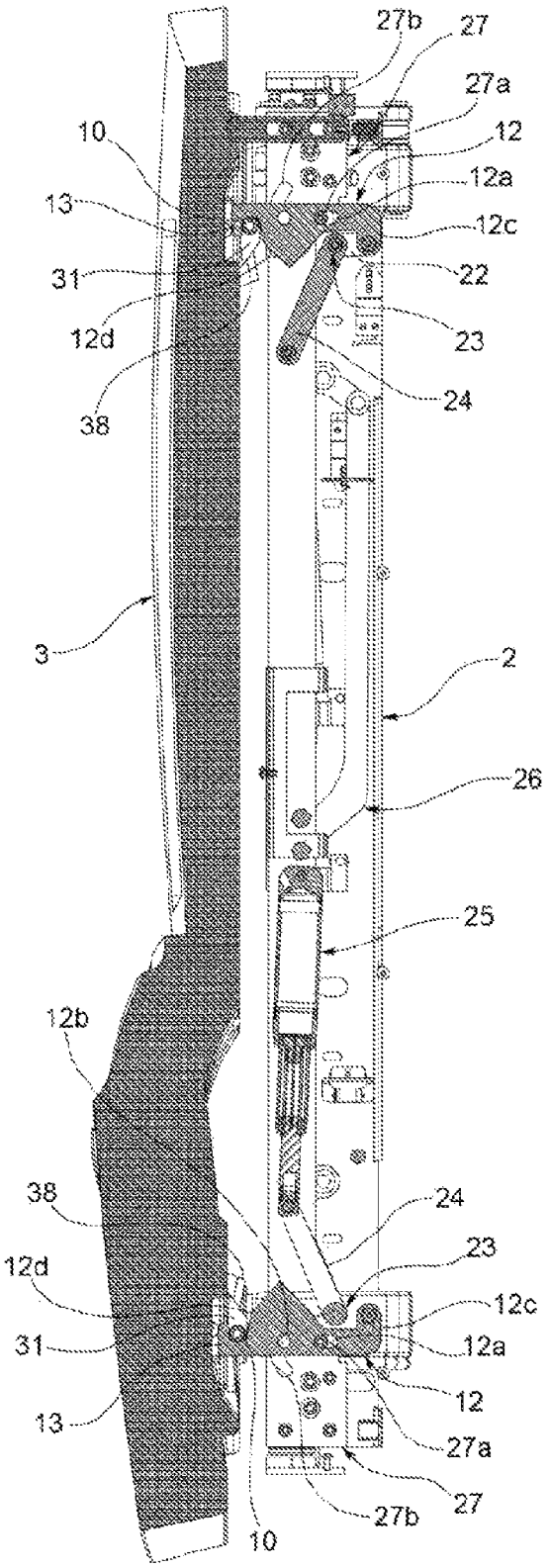
FIG. 2 is a vertically sectioned view of the door according to FIG. 1, in the region of the locking elements.
Figure 3:
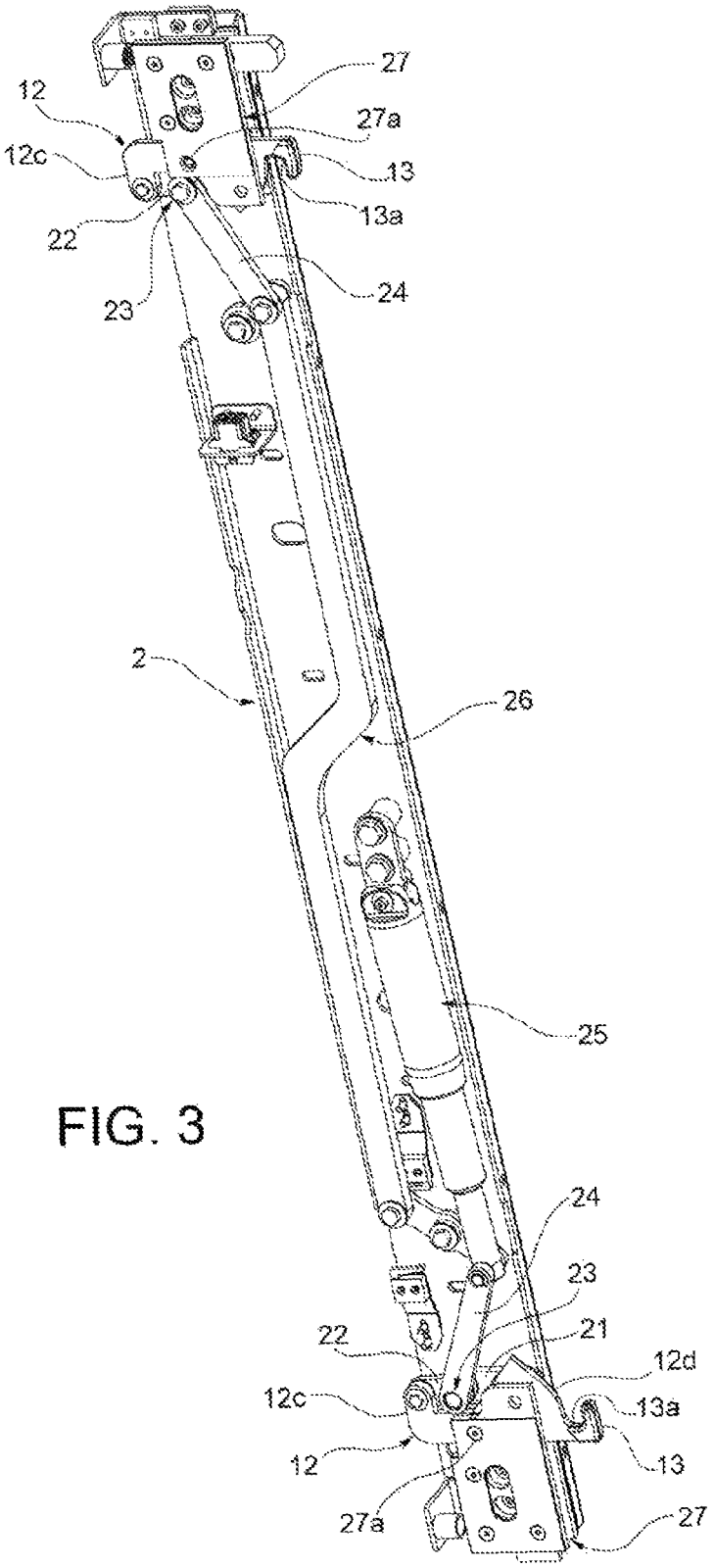
FIGS. 3 and 4 are respectively a perspective view and an elevation view of a part of the frame of the door according to FIG. 1.
Figure 4:
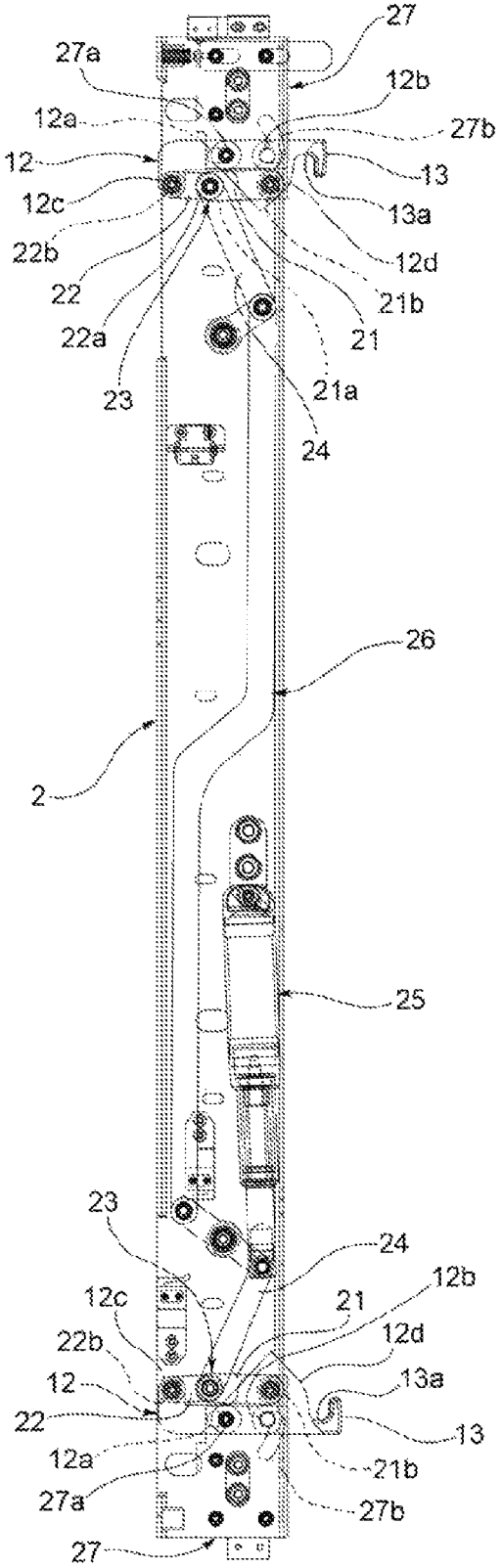
Figure 5:
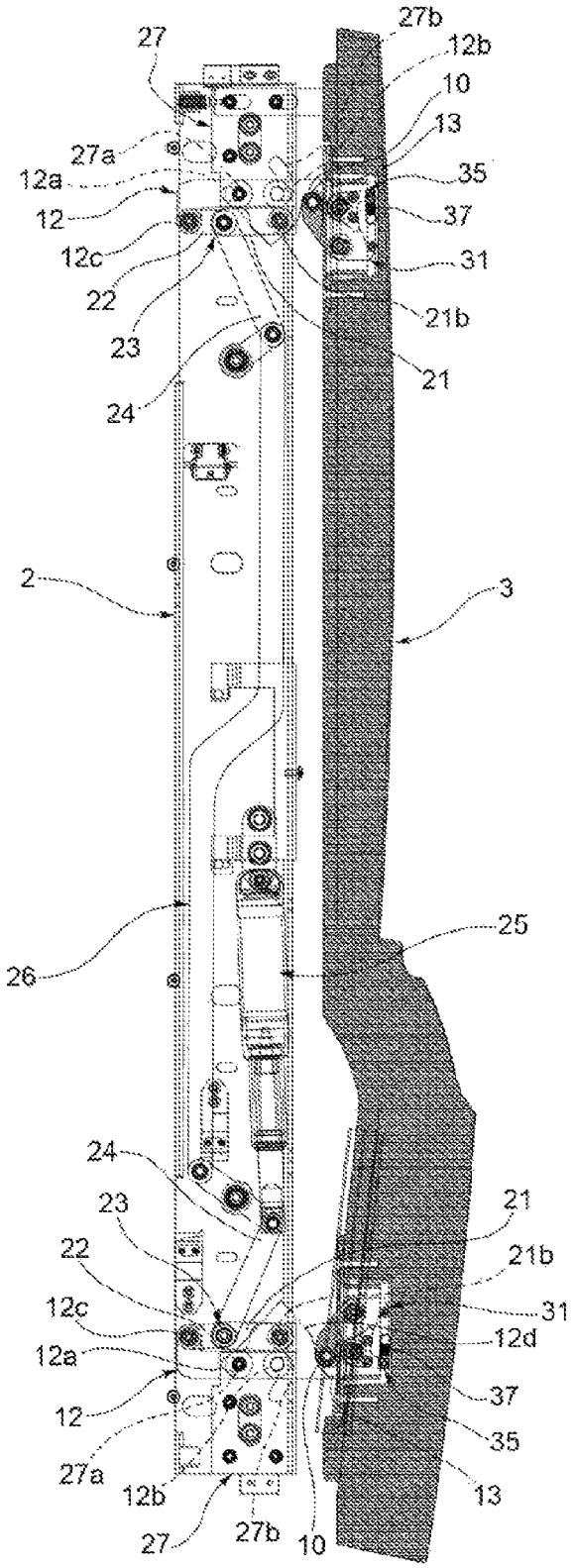
FIG. 5 is a vertically sectioned view of the door according to FIG. 1, in the region of the striker elements.
Figure 6:
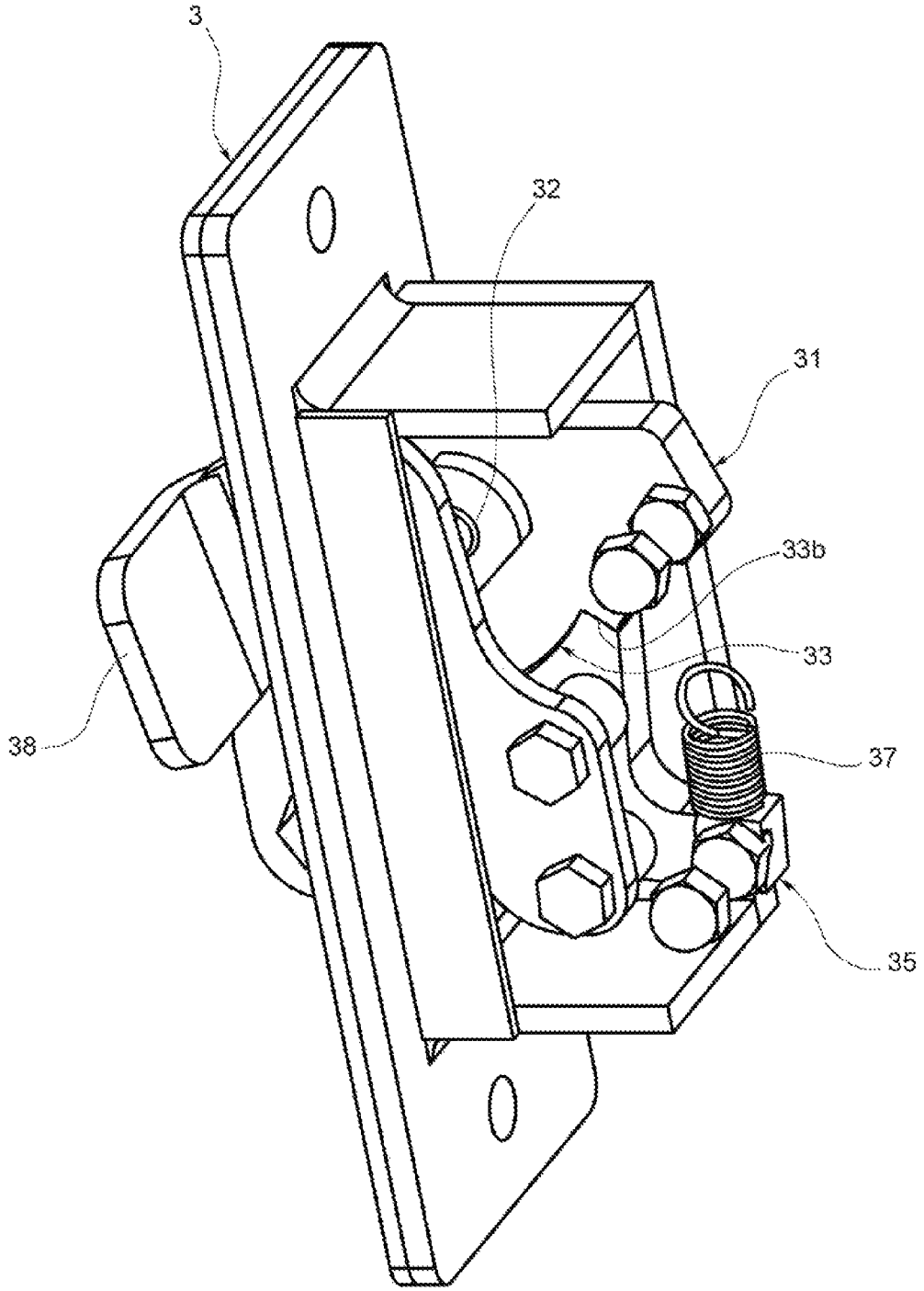
FIGS. 6 and 7 are respectively a perspective view and an elevation view of a mechanism for actuating a striker element of the door according to FIG. 1.
Figure 7:
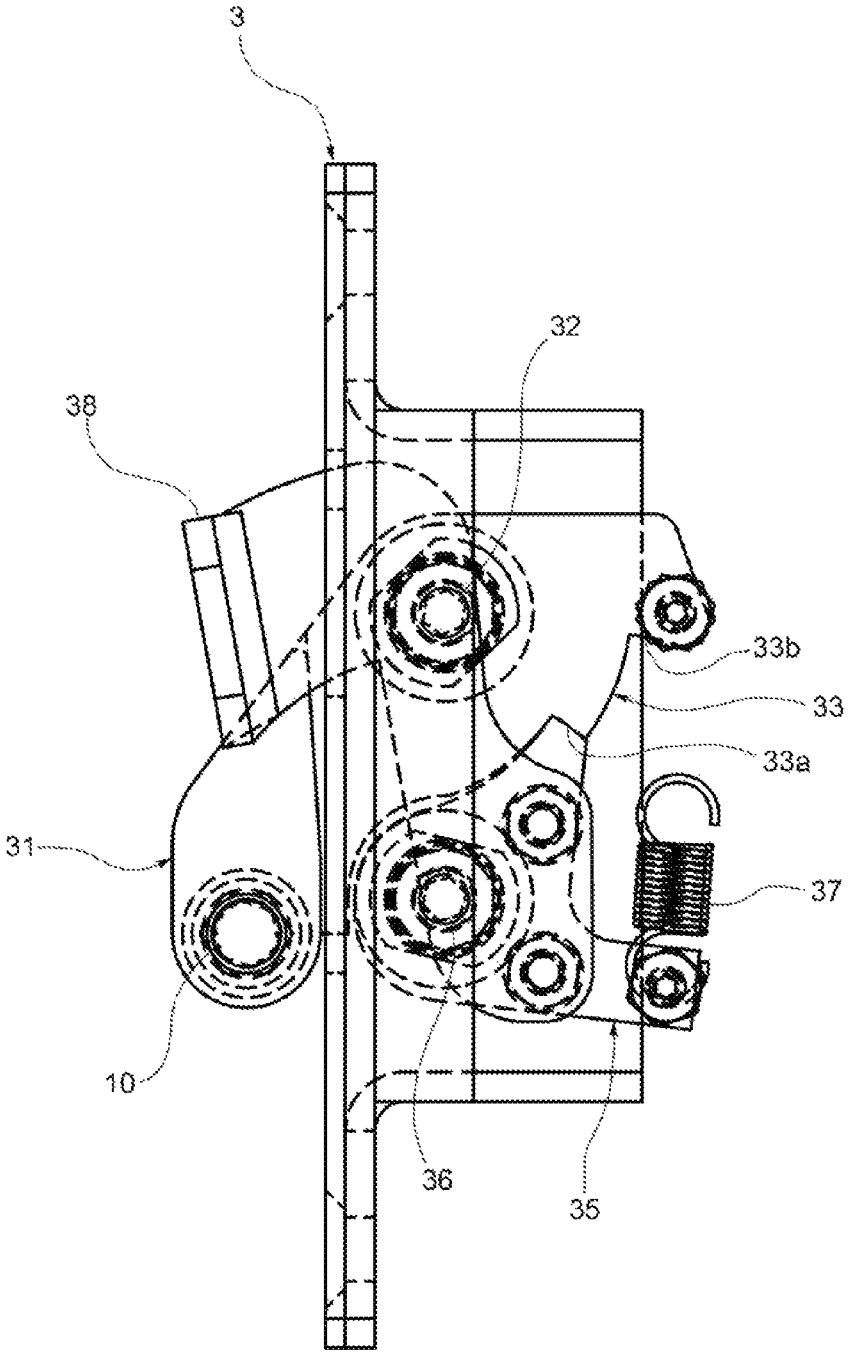
Figure 8:
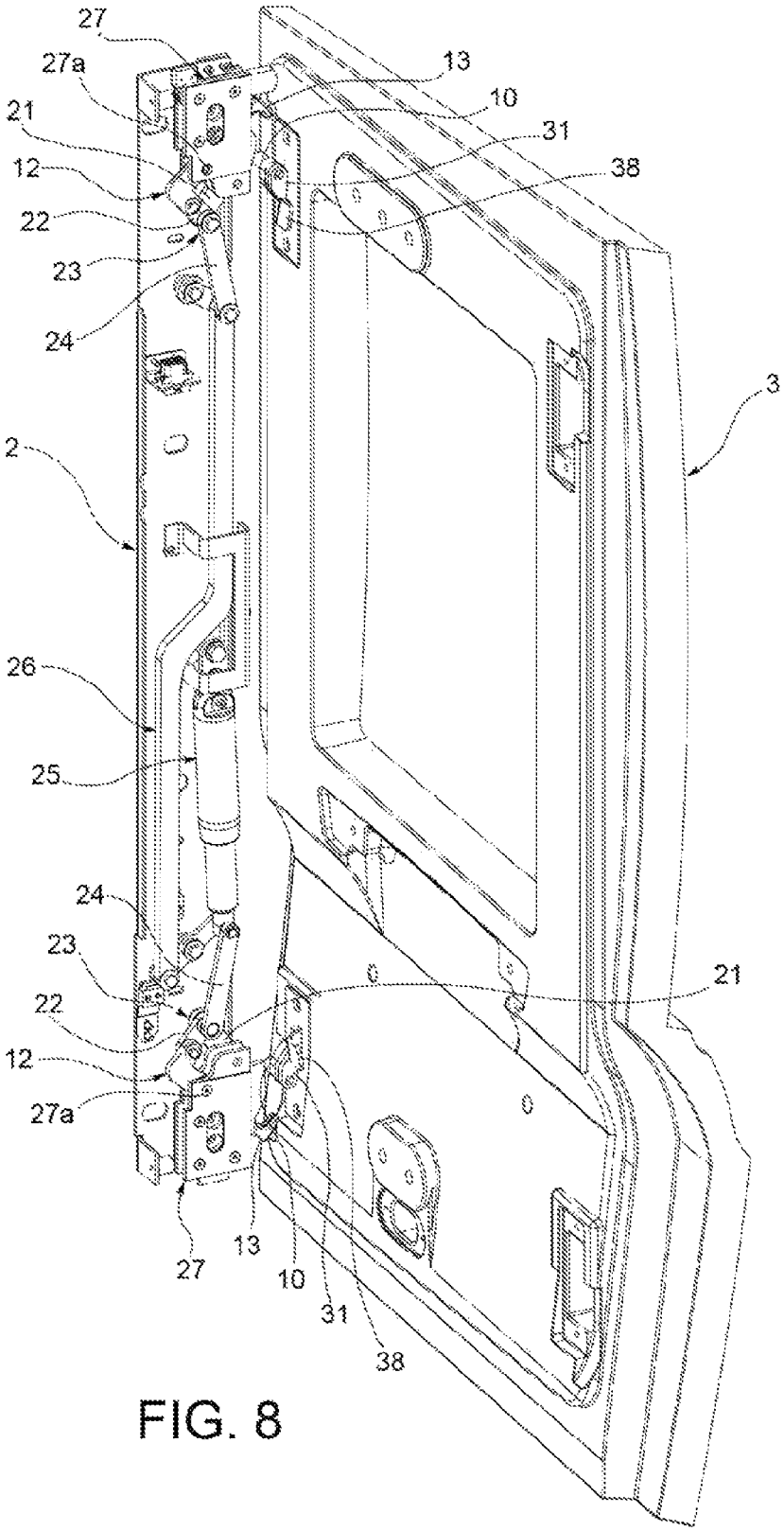
FIG. 8 is a perspective view which shows a watertight door according to FIG. 1, in the closed position and with the locking system disengaged.
Figure 9:
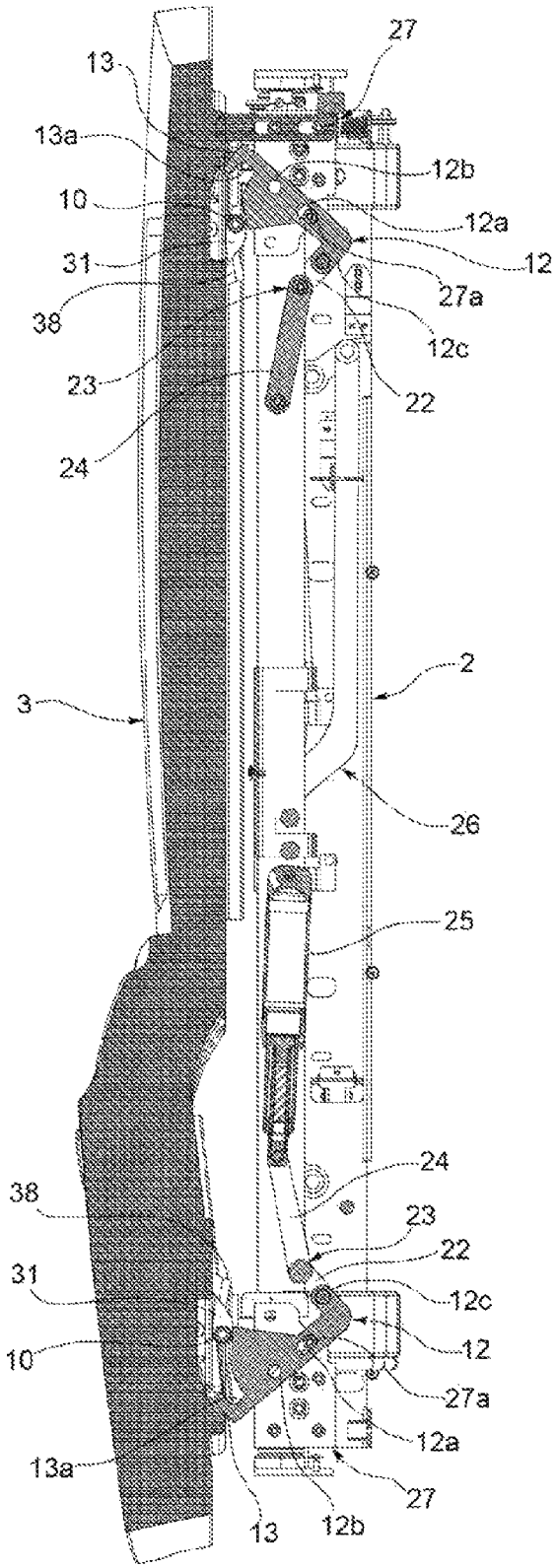
FIG. 9 is a vertically sectioned view of the door according to FIG. 8, in the region of the locking elements.
Figure 10:
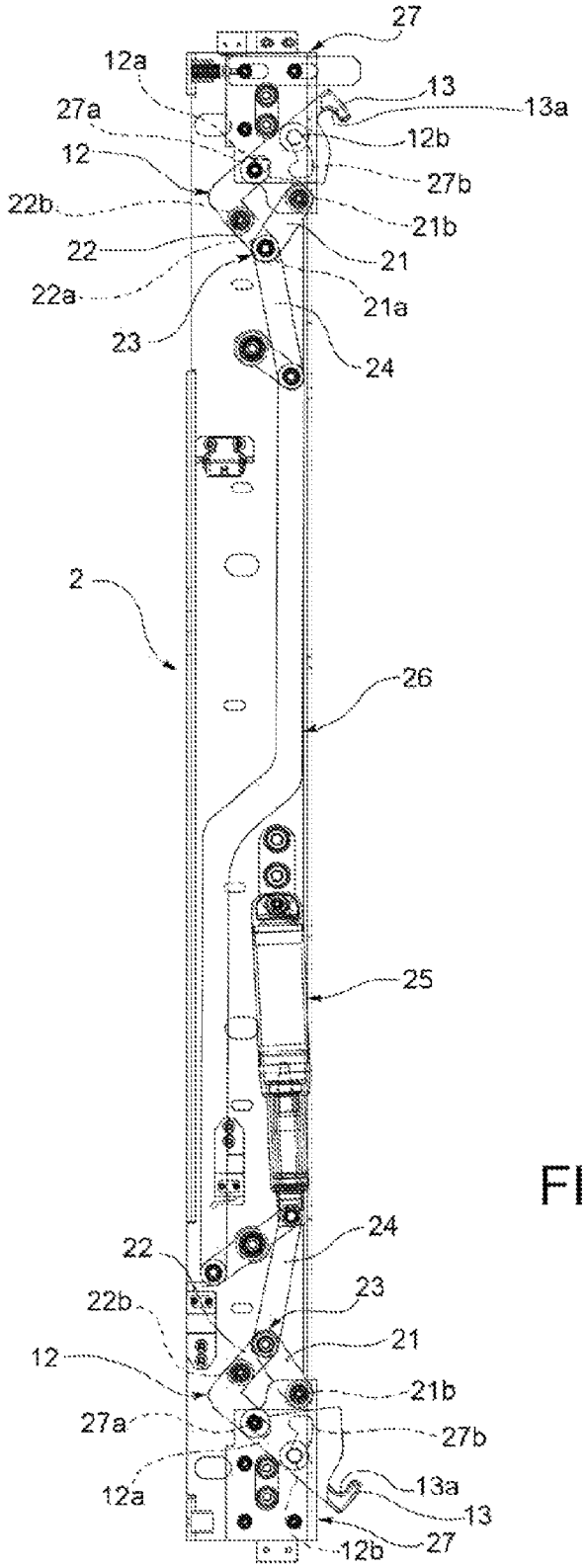
FIG. 10 is an elevation view of part of the frame of the door according to FIG. 8.
Figure 11:
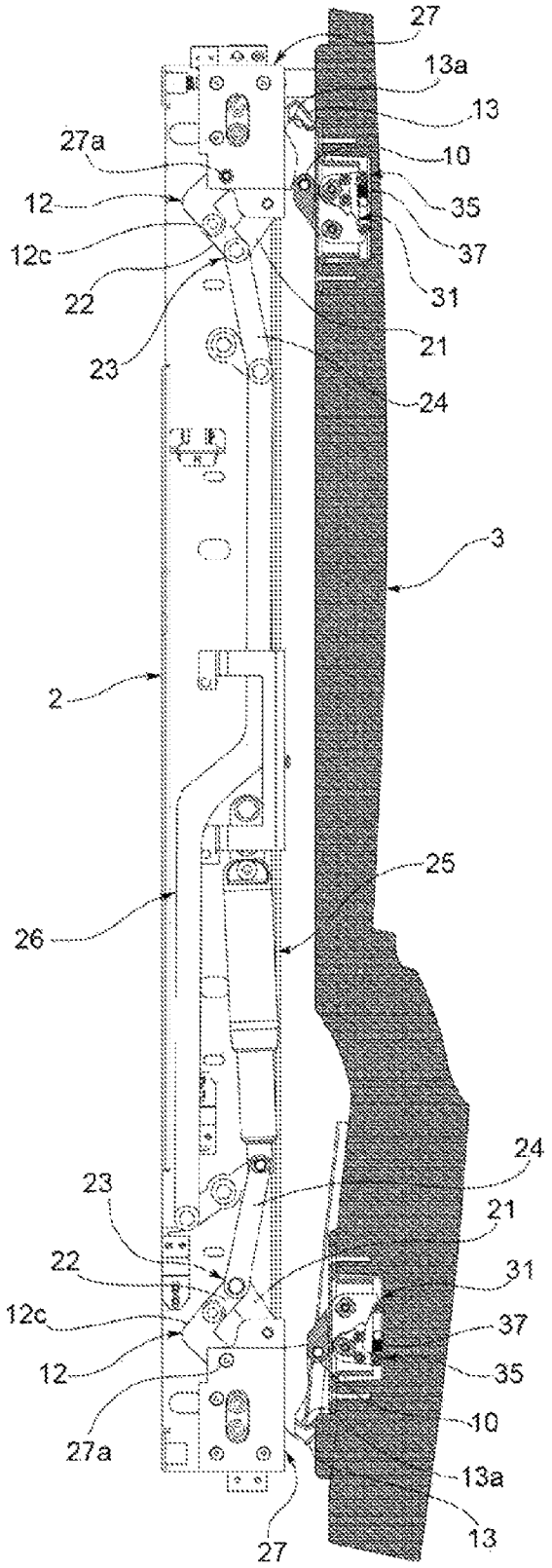
FIG. 11 is a vertically sectioned view of the door according to FIG. 8, in the region of the striker elements.
Figure 12:
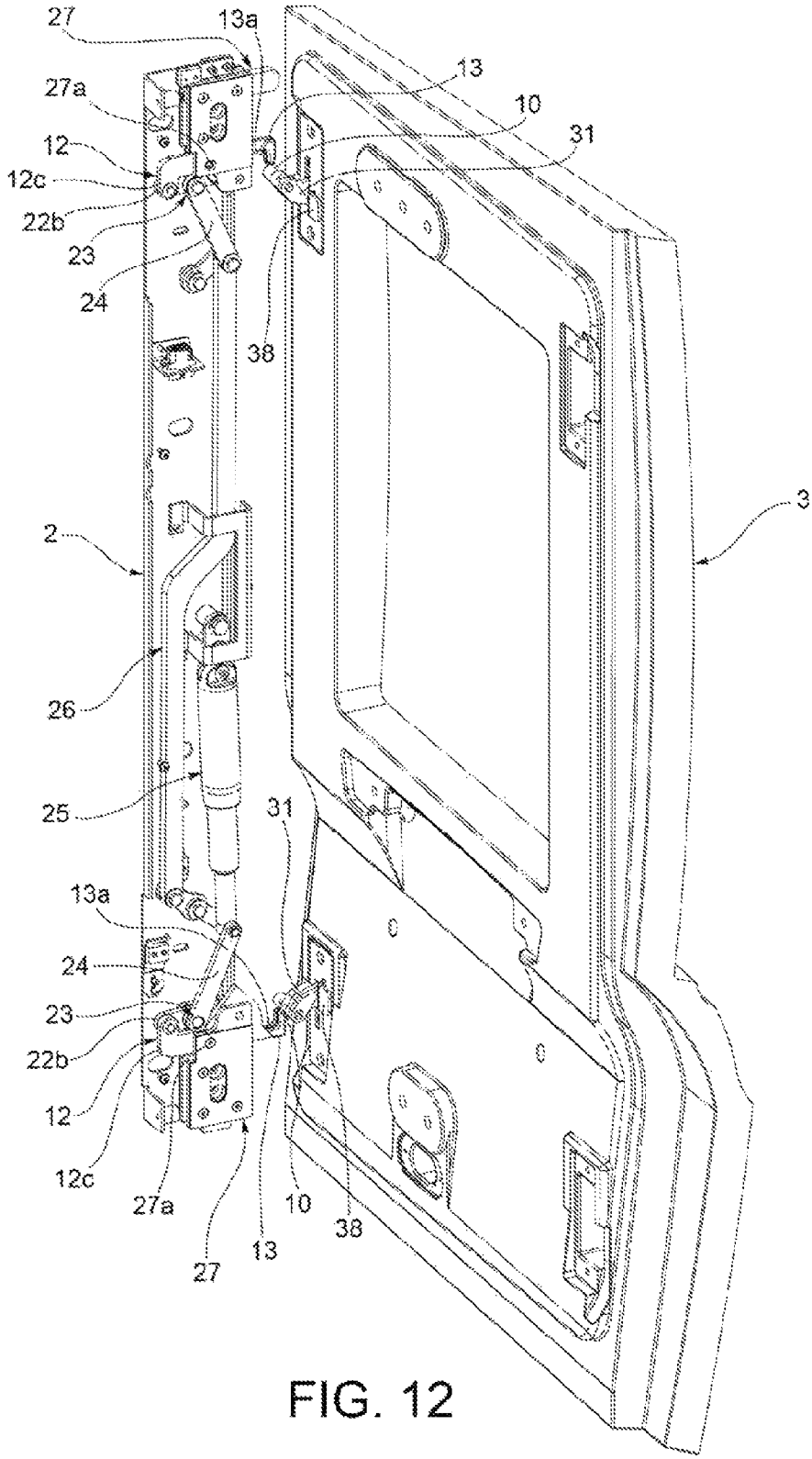
FIG. 12 is a perspective view which shows the watertight door according to FIG. 1, with the locking system engaged, but with the striker elements disengaged.
Figure 13:
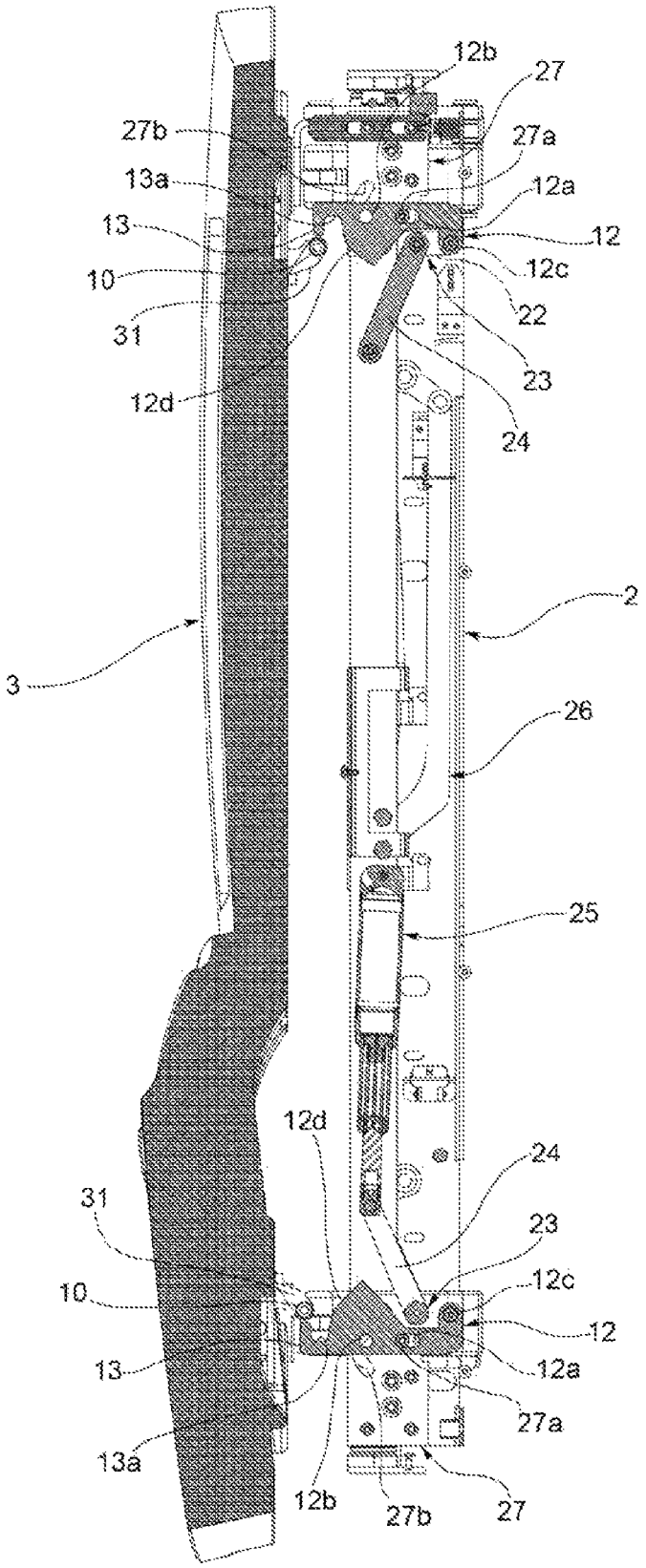
FIGS. 13 and 14 a vertically sectioned views of the door according to FIG. 12, in the region of the locking elements and the striker elements, respectively.
Figure 14:
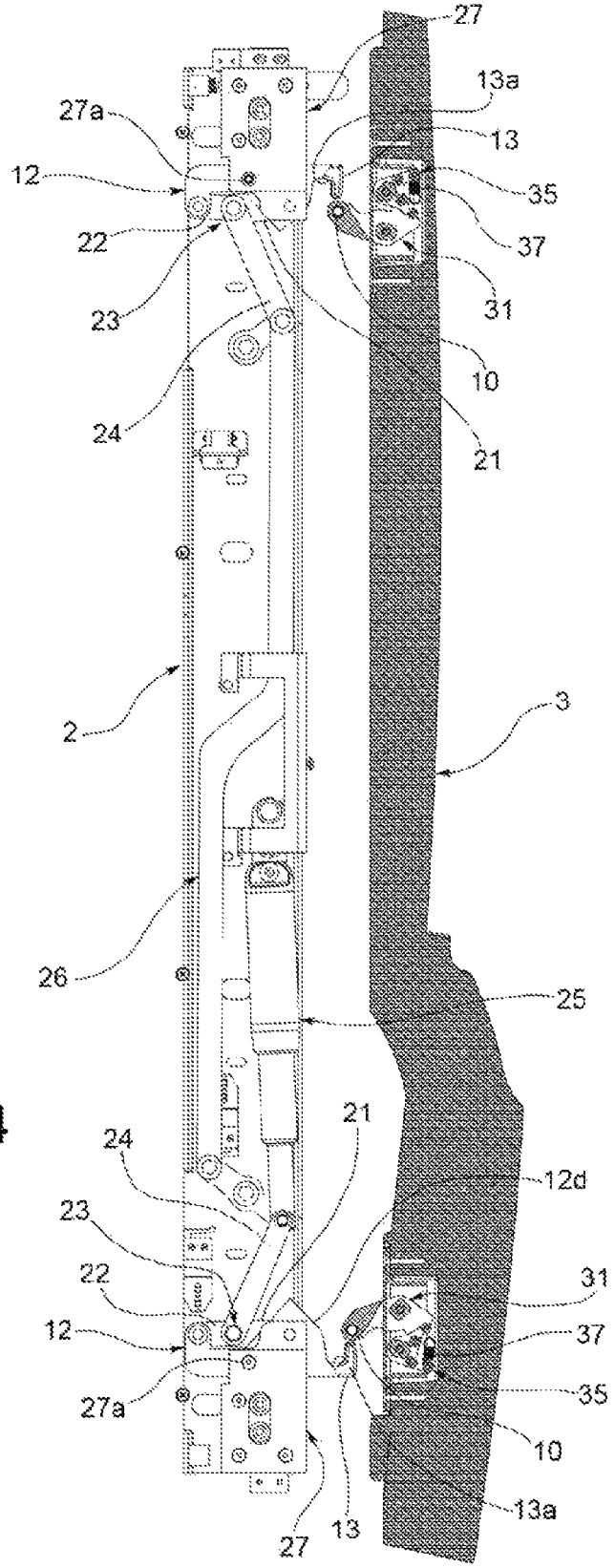
Figure 15:
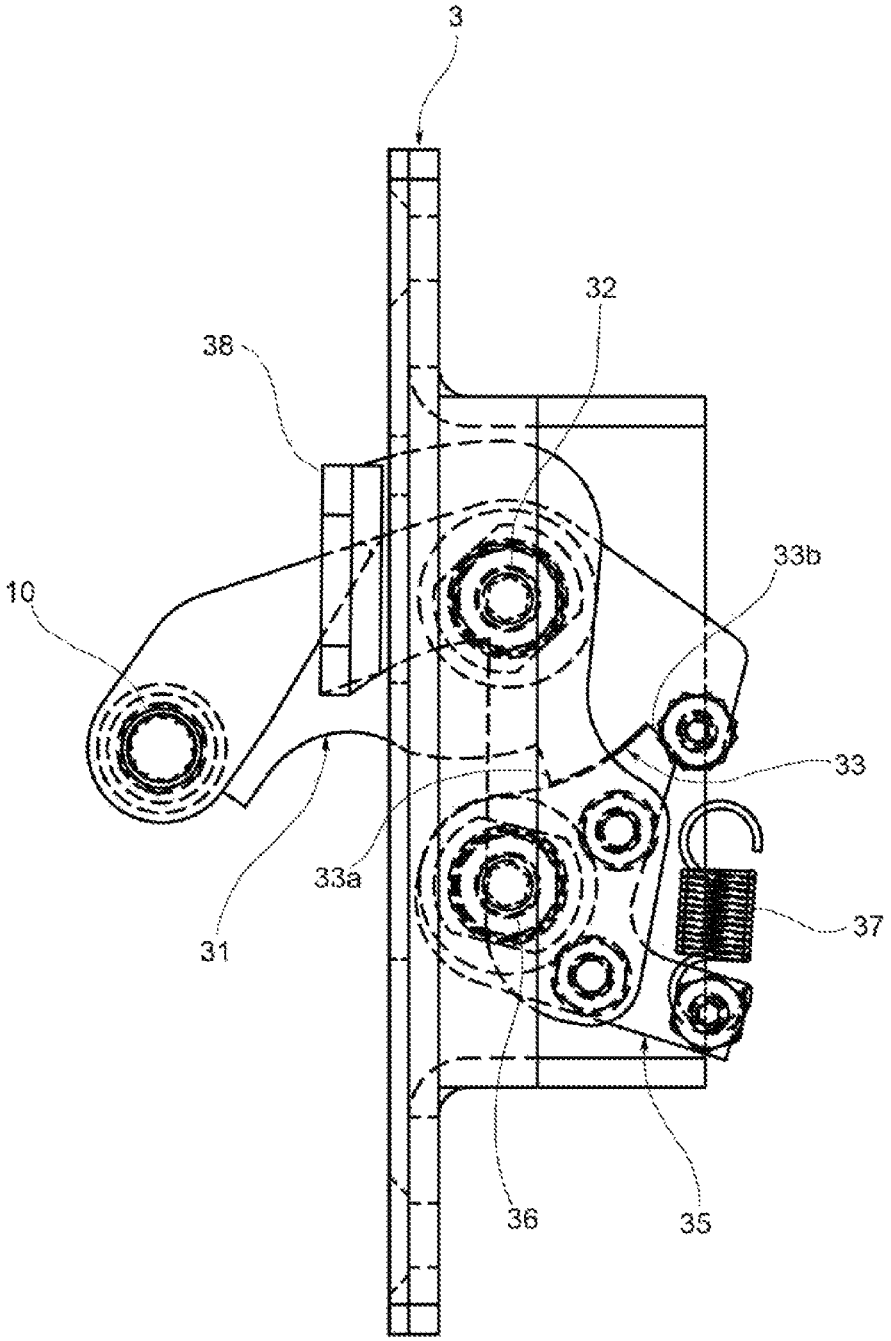
FIG. 15 is an elevation view of the mechanism for actuating a striker element of the door according to FIG. 12.

The watertight door also comprises a locking system which can be operated so as to lock the leaf 3 against the frame 2 when the leaf is in the closed position. In particular, FIGS. 1 to 7 relate to a configuration in which the door is closed and the locking system is engaged, and FIGS. 8 to 11 relate to a configuration in which the door is closed and the locking system is disengaged. The locking system comprises one or more (in the example shown, two) striker elements 10 in the form of pins fixed to the leaf 3, and a respective movable locking elements 12 arranged on the frame 2 and each provided with respective hook element 13 (which can be seen for example in FIGS. 2 to 4) designed to engage with the respective striker element 10 so as to lock the leaf 3 against the frame 2. The locking system also comprises a locking actuating mechanism, also referred to below as main actuating mechanism, intended to actuate the locking elements 12 which are arranged so as to be rotatable and displaceable in a guided manner.

In the example shown, for each locking element 12, the main actuating mechanism comprises a first and a second toggle bar 21 and 22 which are connected together by means of a hinge 23 located at respective ends 21*a* and 22*a*. An opposite end 21*b* of the first toggle bar 21 is hinged with the frame 2 and an opposite end 22*b* of the second toggle bar 22 is hinged with the locking element 12. The main actuating mechanism also comprises an actuating link-bar connected to the hinge 23 of the first and second toggle bars 21 and 22.

The actuating link-bars 24 which are respectively associated with the locking elements 12 are connected to a pneumatic, hydraulic and/or electric actuator 25, directly or via a transmission element 26, so as to actuate the locking elements 12 via the main actuating mechanism. According to an alternative embodiment (not shown) control of the locking system may be performed manually, for example by means of a wheel or knob connected to the mechanisms for actuating the locking elements.

Each locking element 12 has a longitudinal eyelet 12*a* and a guide pin 12*b* which are arranged between the hook end 13 of the locking element 12 and an opposite end 12*c* of the locking element 12 hinged with the second toggle bar 22. The main actuating mechanism also includes a guide element 27 which is fixed to the frame and coupled with each locking element 12. The guide element 27 comprises a rotational pin 27*a* which is slidably inserted inside the longitudinal eyelet 12*a* of the locking element 12, and a guide slot 27*b* inside which the guide pin 12*b* of the locking element 12 is slidably inserted. The guide slot 27*b* comprises a curvilinear section and a straight section.

Switching of the locking system from the disengaged position shown in FIGS. 8-11 to the engaged position shown in FIGS. 1-7 may be described as follows. Upon activation of the locking system, which may occur automatically (for example triggered by sensors) or be performed by an operator, the actuator 25 via the actuating link-bar 24 causes splaying of the toggle bars 21 and 22 until these reach the point where the central hinge 23 is approximately arranged on a straight line which joins together the hinges of the opposite ends of the bars 21 and 22. At the same time, the displacement of the second hinge bar 22 causes a displacement of the locking element 12, consisting in a rotation about the rotational pin 27*a* of the guide element 27, which is guided by the curvilinear section of the guide eyelet 27*b* of the guide element 27 and which causes the hook end 13 of the locking element 12 to clasp the striker element 10, and in a displacement, which is guided by the straight section of the guide eyelet 27*b* of the guide element 27 and which causes the hook end 13 of the locking element 12 to pull the striker element 12, and therefore the leaf 3, towards the frame 2.

Switching of the locking system from the engaged position shown in FIGS. 1-7 to the disengaged position shown in FIGS. 8-11 occurs, under normal conditions, by means of actuation of the actuator 25 so as to perform a movement which is the opposite of that described above.

The door described above also has a striker actuating mechanism, referred to below also as emergency actuating mechanism, for the possibility where, for example following a malfunction, it is not possible to disengage the locking system by operating the main actuating mechanism. The operating principle of the emergency actuating mechanism is illustrated in particular in FIGS. 12-15.

The emergency actuating mechanism is arranged on the leaf 3 and can be operated when the leaf 3 is in the closed position and the locking elements 12 are engaged with the respective striker elements 10. The emergency actuating mechanism is intended to cause the striker element 10 to switch from a closed position (referred to below also as normal position) into an open position (referred to below also as emergency position. The closed/normal position is that shown in FIGS. 1-11 and is fundamentally the position in which, when the door is closed and the locking system is engaged, the striker element 10 is located inside the recess 13*a* defined by the hook end 13 of the locking element 12. Correspondingly, the open/emergency position, shown in FIGS. 12-15, is the position in which the striker element 10 is extracted from the recess 13*a* of the hook end 13 of the locking element 12. In this position it is possible to open the door again since the striker element 10 no longer interferes with the movement of the hook end 13 of the locking element 12.

The emergency actuating mechanism comprises, for each striker element 10, a support element 31 pivoting about a rotation axis 32 fixed to the leaf 3. The support element 31, which is a kind of rocker arm, has at one end a striker element 10 and is provided at the opposite end with a toothed edge 33 comprising a first and a second tooth 33*a* and 33*b*. The emergency mechanism also comprises a ratchet element 35 pivoting about a rotation axis 36 fixed to the leaf 3 and elastically tensioned by means of a spring 37 connected at one end to the ratchet element 35 and at the other end to an end of the support element 31 situated opposite to the striker element 10. For the sake of simplicity, in the figures the spring 37 is always shown in the rest position and fastened only to the ratchet element.

The ratchet element 35 is designed to engage selectively with the first or second tooth 33, 33*b* of the support element 33 so as to define respectively the normal position and the emergency position of the striker element 10.

Also envisaged is a control member 38 which can be operated manually and is connected to the ratchet element 35, directly or by means of a transmission element, so as to trigger the striker element 10 by means of the emergency actuating mechanism. In the example shown, the control member 38 is in the form of a lever which is connected to the respective ratchet element 35. According to an alternative embodiment (not shown) a centralized configuration may be provided, where a single control member is able to operate a plurality of striker elements 10. In this case several kinematic chains are present these allow operation of the mechanisms for actuating the various striker members by operating a single control member.

Basically, when the door is in the position shown in FIGS. 1-7, operation of each control member 38 causes rotation of the ratchet element 35 against the force of the spring 37. This rotation causes a tip of the ratchet element 37 to slide along the profile of the first tooth 33*a* of the support element 31. As soon as the tip of the ratchet element 37 releases the first tooth 33*a* of the support element, the force of the spring 37 causes a simultaneous rotation of the ratchet element 35 and the support element 31, which stops when the tip of the ratchet element 35 engages with the second tooth 33*b* of the support element 31 (FIGS. 12-15). Owing to the rotation of the support element 31, the striker element 10 is then released from engagement with the respective locking element 12; the door may thus be opened again.

The emergency actuating mechanism can be reset after the leaf 3 has been closed again, owing to the fact that the striker element 10 is elastically tensioned. For this purpose, in the example shown, the locking element 12 has a ramp edge 12*d* arranged adjacent to the hook end 13. This ramp edge 12*d* is designed to engage with the striker element 10 in the emergency position; the movement of the leaf 3 towards the closed position therefore causes a rotation of the support element 31 against the action of the spring 37. This rotation causes the tip of the ratchet element 37 to leave the second tooth 33*b* of the support element and slide along the rear profile of the first tooth 33*a*. As soon as the tip of the ratchet element 35 releases the first tooth 33*a* of the support element, the force of the spring 37 causes the simultaneous rotation of the ratchet element 35 and the bracket element 31, which stops when the tip of the ratchet element 35 engages with the edge 33 of the support element 31 in front of the first tooth 33*a*. The emergency actuating mechanism is thus reset.

The emergency actuating mechanism may therefore be used to open and close the door as required, in the event where immediate action is not possible in order to repair a malfunction of the main actuating mechanism.

Figure 16:
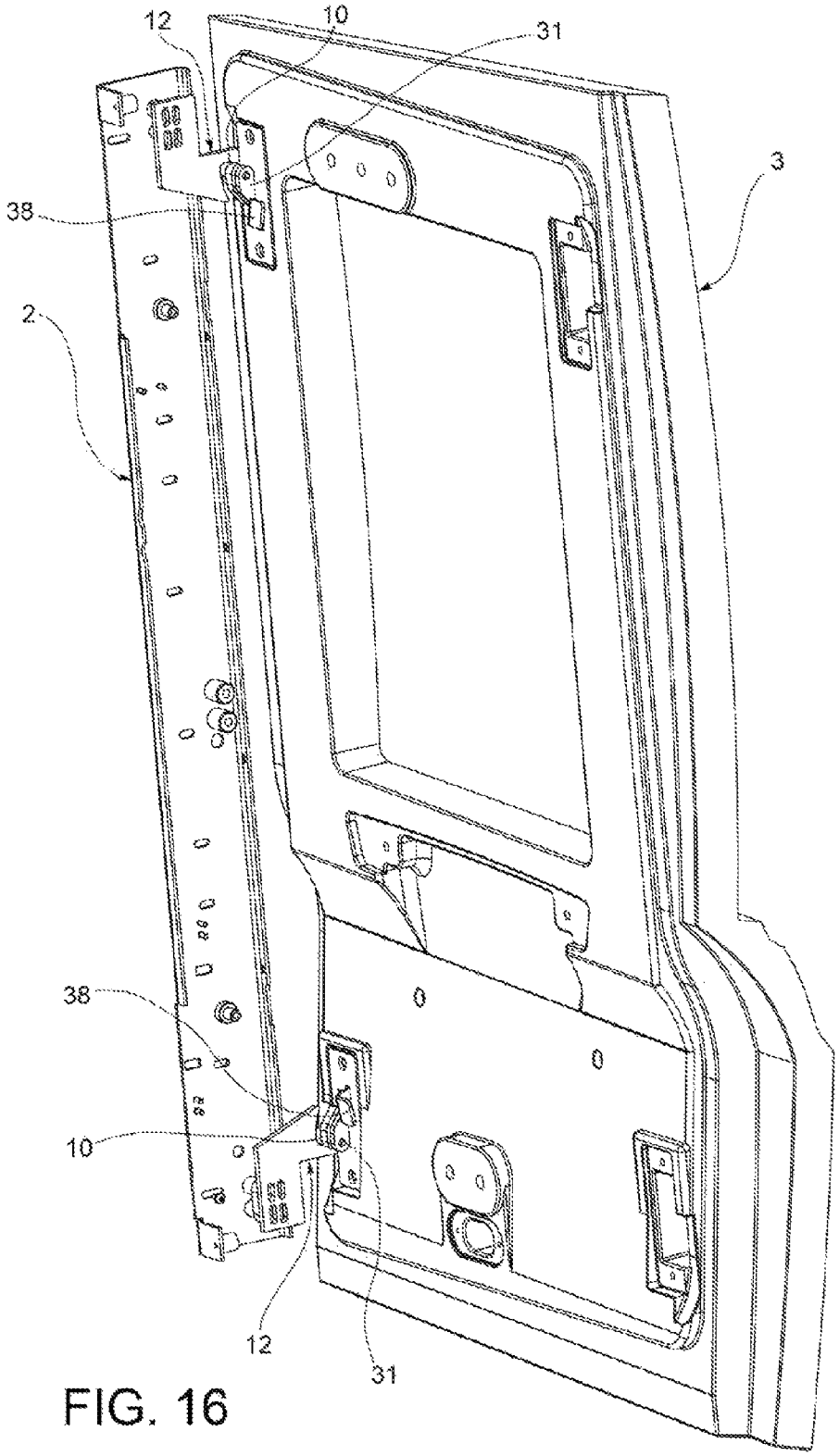
FIGS. 16 and 17 are perspective views which show another embodiment of the watertight door according to the invention, in the closed position and open position, respectively.
Figure 17:
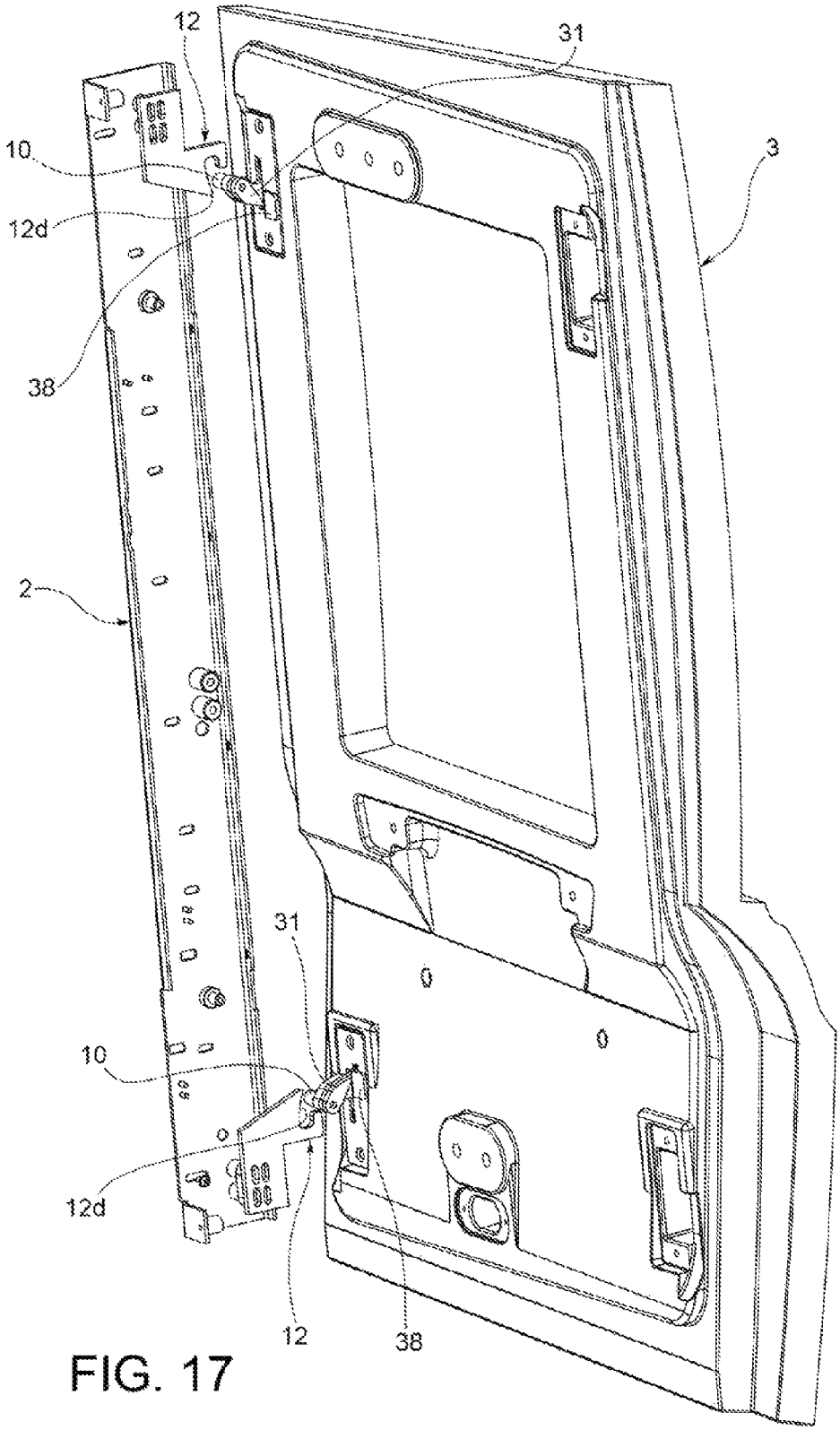

FIGS. 16 and 17 show another sealed door according to the invention. The same reference numbers have been assigned to elements corresponding to those of the preceding embodiment; these numbered elements will not be further described. The embodiment shown in FIGS. 16 and 17 differs from that preceding embodiment solely in that it does not have a locking system with a locking actuating mechanism associated with the locking elements 12, and the locking elements 12 are not movable, but are arranged fixed to the frame 2. In this case the striker actuating mechanism acts as normal actuating mechanism for opening the leaf. The striker actuating mechanism of the door shown in FIGS. 16 and 17 is identical to that described above and shown in FIGS. 6, 7 and 15.

The invention claimed is:

1. A watertight door or window comprising:

a frame;

a leaf mounted on the frame and arranged movably relative to the frame between an open position and a closed position;

a striker element arranged on the leaf;

a locking element arranged on the frame and provided with a hook end designed to engage with the striker element in order to lock the leaf against the frame following closing of the leaf;

a locking system operable to lock the leaf against the frame when the leaf is in the closed position, said locking system comprising a locking actuating mechanism that actuates the locking element, the locking element being rotatable and displaceable in a guided manner relative to the frame; and a striker actuating mechanism arranged on the leaf and actuatable when the leaf is in a closed position and the locking element is engaged with the striker element, said striker actuating mechanism releasing the striker element from a closed position, where the striker element is positioned inside a recess in the hook end of the locking element, to an open position, where the striker element is extracted from the recess in the hook end of the locking element, and said striker actuating mechanism is resettable when the leaf is again in the closed position, wherein the striker actuating mechanism provides an emergency actuating mechanism for moving the leaf to the open position.

2. A watertight door or window according to claim 1, wherein the striker actuating mechanism comprises a support element which pivots about a rotation axis fixed to the leaf and which carries the striker element and is provided with a toothed edge comprising a first and second tooth, and a ratchet element elastically tensioned and designed to engage selectively with the first or second tooth of the support element so as to define respectively the closed position and the open position of the striker element.

3. A watertight door or window according to claim 2, further comprising a control member which can be operated manually and is connected to the ratchet element, directly or by means of a transmission element, so as to release the striker element by means of the striker actuating mechanism.

4. A watertight door or window according to claim 3, comprising a plurality of said striker elements and respective locking elements, said striker elements being operationally connected to a single control member which can be manually operated.

5. A watertight door or window according to claim 1, wherein the locking element has a ramp edge arranged adjacent to the hook end and designed to engage with the striker element in the closed position so as to reset the actuating mechanism when the leaf is closed again.

6. A watertight door or window according to claim 1, wherein the locking actuating mechanism comprises a first and a second toggle bar connected together by means of a hinge at respective ends, an opposite end of the first toggle bar being hinged with the frame and an opposite end of the second toggle bar being hinged with the locking element, as well as an actuating link-bar connected to the hinge of the first and second toggle bars.

7. A watertight door or window according to claim 6, wherein the locking element comprises a longitudinal eyelet and a guide pin arranged between the hook end of the locking element and an opposite end of the locking element hinged with the second toggle bar and wherein the main actuating mechanism also includes a guide element fixed to the frame and coupled with the locking element and comprising a rotational pin slidably inserted inside the longitudinal eyelet of the locking element and a guide slot inside which the guide pin of the locking element is slidably inserted, said guide slot comprising a curvilinear section and a straight section.

8. A watertight door or window according to claim 6, further comprising one of a pneumatic, hydraulic or electrical actuator connected to the actuating link-bar, directly or by means of a transmission element, so as to operate the locking element by means of the locking actuating mechanism.

* * * * *